US011963548B2

(12) United States Patent
Booth

(10) Patent No.: US 11,963,548 B2
(45) Date of Patent: Apr. 23, 2024

(54) SMOKING PIPE WITH FOLDING STEM

(71) Applicant: Wolf Grinders Inc., Edmonton (CA)

(72) Inventor: Nicholas Booth, Edmonton (CA)

(73) Assignee: Wolf Grinders Inc., Edmonton (CA)

( * ) Notice: Subject to any disclaimer, the term of this patent is extended or adjusted under 35 U.S.C. 154(b) by 751 days.

(21) Appl. No.: 17/054,751

(22) PCT Filed: Jun. 5, 2019

(86) PCT No.: PCT/CA2019/050783
§ 371 (c)(1),
(2) Date: Nov. 11, 2020

(87) PCT Pub. No.: WO2019/232627
PCT Pub. Date: Dec. 12, 2019

(65) Prior Publication Data

US 2021/0219602 A1 Jul. 22, 2021

Related U.S. Application Data

(60) Provisional application No. 62/680,802, filed on Jun. 5, 2018.

(51) Int. Cl.
*A24F 5/10* (2006.01)
*A24F 1/00* (2006.01)
*A24F 7/00* (2006.01)

(52) U.S. Cl.
CPC ..... *A24F 1/00* (2013.01); *A24F 5/10* (2013.01); *A24F 7/00* (2013.01)

(58) Field of Classification Search
CPC ..... A24F 1/00; A24F 5/10; A24F 7/00
See application file for complete search history.

(56) References Cited

U.S. PATENT DOCUMENTS 4,252,135 A 2/1981 Herman
5,464,026 A 11/1995 Gardner et al.
(Continued)

FOREIGN PATENT DOCUMENTS

CN 205962820 U 2/2017
CN 107616548 A 1/2018
(Continued)

OTHER PUBLICATIONS

International Search Report and Written Opinion dated Aug. 15, 2019, issued in corresponding Application No. PCT/CA2019/050783, filed Jun. 5, 2019, 8 pages.

*Primary Examiner* — Vanessa Girardi
(74) *Attorney, Agent, or Firm* — Christensen O'Connor Johnson Kindness PLLC

(57) ABSTRACT

A portable inhalation apparatus is provided comprising a base and a collapsible stem assembly. In some embodiments, the portable inhalation apparatus is a smoking pipe. The collapsible stem assembly may have an extended position in which the stem assembly extends away from the base and a collapsed position in which the stem assembly is collapsed towards the base. When the stem assembly is in the collapsed position, the smoking pipe may be in a compact form to store and transport the smoking pipe. The stem assembly may comprise at least two stem sections and at least one articulating connection interconnecting the stem sections. A related method for making a portable inhalation apparatus is also provided.

20 Claims, 12 Drawing Sheets

(56) References Cited

U.S. PATENT DOCUMENTS

| | | | | |
|---|---|---|---|---|
| 5,850,838 | A | 12/1998 | Sigrist | |
| 6,196,232 | B1 * | 3/2001 | Chkadua | A24F 1/00 131/225 |
| 6,595,206 | B2 * | 7/2003 | Vito | B05B 15/656 128/200.23 |
| 6,736,143 | B2 | 5/2004 | Rennecamp | |
| 8,590,540 | B2 | 11/2013 | Kahn | |
| 2016/0345623 | A1 | 12/2016 | Pearson et al. | |
| 2016/0366932 | A1 | 12/2016 | Weddington | |

FOREIGN PATENT DOCUMENTS

| | | | |
|---|---|---|---|
| CN | 207167749 | U | 4/2018 |
| EP | 0033396 | A1 | 8/1981 |
| FR | 392350 | A | 11/1908 |
| WO | 2019076204 | A1 | 4/2019 |

* cited by examiner

SMOKING PIPE WITH FOLDING STEM

RELATED APPLICATIONS

This application claims priority to U.S. Provisional Patent Application No. 62/680,802 filed Jun. 5, 2018, the entire contents of which are incorporated herein by reference.

FIELD OF THE DISCLOSURE

The present disclosure relates to portable inhalation apparatuses. More particularly, the present disclosure relates to smoking pipes and related methods.

BACKGROUND

Smoking pipes typically comprise a base, such as a bowl, and an elongated pipe stem. The pipe stem may extend away from the base with a mouthpiece at a distal end. The bowl may hold an amount of smoking material, such as tobacco, that may be lit by fire to generate smoke. The pipe user may inhale on the mouthpiece to draw the smoke from the bowl through the pipe stem and into the mouth and lungs of the pipe user.

Conventional smoking pipes, with their elongated pipe stems, may be inconvenient for storage and transport between smoking sessions. For example, a conventional pipe may be too large to fit comfortably in a pocket of the user's clothing. Some smoking pipes have detachable stems; however, there is a risk of the detached stem being misplaced or lost. In addition, some smoking pipes have closure systems that come undone easily and may spill smoking material into the user's bag or pocket.

SUMMARY

In one aspect, there is provided a portable inhalation apparatus comprising: a base comprising a chamber and a ventilation channel extending from the chamber to an outer face of the base; a collapsible stem assembly defining a longitudinal conduit therethrough, the stem assembly having a first end and an opposed second end, the first end coupled to the base such that the longitudinal conduit is alignable with the ventilation channel and the second end comprising a suction opening to the longitudinal conduit; wherein the collapsible stem assembly has an extended position in which the stem assembly extends away from the base and a collapsed position in which the stem assembly is collapsed towards the base.

In some embodiments, the second end of the stem assembly is distal the base and the suction opening is in fluid communication with the open chamber via the longitudinal conduit, when the collapsible stem assembly is in the extended position.

In some embodiments, the second end is proximate the base, when the stem assembly is in the collapsed position.

In some embodiments, the at least two stem sections comprise a first stem section and a second stem section rotatably coupled to the first stem section.

In some embodiments, the at least two stem sections further comprise a third stem section rotatably coupled to the second stem section.

In some embodiments, the at least two stem sections are interconnected by at least one hinge.

In some embodiments, the stem assembly is rotatably coupled to the base.

In some embodiments, the portable inhalation apparatus further comprises at least one magnet positioned on at least one of the base and the stem assembly to generate a magnetic force to hold the stem assembly in the extended position.

In some embodiments, the at least one magnet comprises a first magnet positioned on the base proximate to the stem assembly and a second magnet positioned on the stem assembly such that a magnetic force is generated between the first magnet and the second magnet when the stem assembly is in the extended position.

In some embodiments, the portable inhalation apparatus further comprises a cover member that engages the base to cover the chamber.

In some embodiments, the cover member is pivotably attached to the base, the cover member pivotable between an open position in which the open chamber is uncovered and a covering position in which the open chamber is covered.

In some embodiments, the portable inhalation apparatus further comprises at least one securing magnet positioned to magnetically engage the stem assembly with the base or the cover member when the stem assembly is in the collapsed position.

In some embodiments, the at least one securing magnet comprises a first securing magnet positioned on one of the base or the cover member and a second securing magnet positioned on the stem assembly such that a magnetic force is generated between the first securing magnet and the second securing magnet when the stem assembly is in the collapsed position.

In some embodiments, the cover member provides clearance for at least a portion of the stem assembly when the stem assembly is in the collapsed position.

In another aspect, there is provided a method for making a portable inhalation apparatus, the method comprising: providing a base; providing a collapsible stem assembly; and coupling the stem assembly to the base.

In some embodiments, the stem assembly is coupled to the base using an articulating connection.

In another aspect, there is provided a stem assembly for a portable inhalation apparatus comprising: a first stem section; a second stem section; and at least one articulating connection interconnecting the first stem section and the second stem section.

In some embodiments, the at least one articulating connection comprises at least one hinge.

In some embodiments, the stem assembly further comprises at least one magnet positioned to magnetically engage one of the at least two stem sections with an adjacent one of the at least two stem sections.

Other aspects and features of the present disclosure will become apparent, to those ordinarily skilled in the art, upon review of the following description of the specific embodiments of the disclosure.

DESCRIPTIONS OF THE DRAWINGS

Some aspects of the disclosure will now be described in greater detail with reference to the accompanying drawings. In the drawings.

DETAILED DESCRIPTION OF THE EMBODIMENTS

Generally, the present disclosure provides a portable inhalation apparatus. In some embodiments, the portable inhalation apparatus is a smoking pipe. In other embodiments, the portable inhalation apparatus is a vaporizer. In some embodiments, the portable inhalation apparatus comprises a base and a collapsible stem assembly. The collapsible stem assembly may have an extended position in which the stem assembly extends away from the base and a collapsed position in which the stem assembly is collapsed towards the base. A related method for making a portable inhalation apparatus is also provided.

As used herein, the terms "top" and "bottom", "upper" and "lower", "upward" and "downward" and the like refer to the typical orientation of a smoking pipe when used for smoking; however, a person skilled in the art will recognize that these are relative terms that are used for ease of description only and do not limit the orientation of the smoking pipes described herein.

Figure 1:
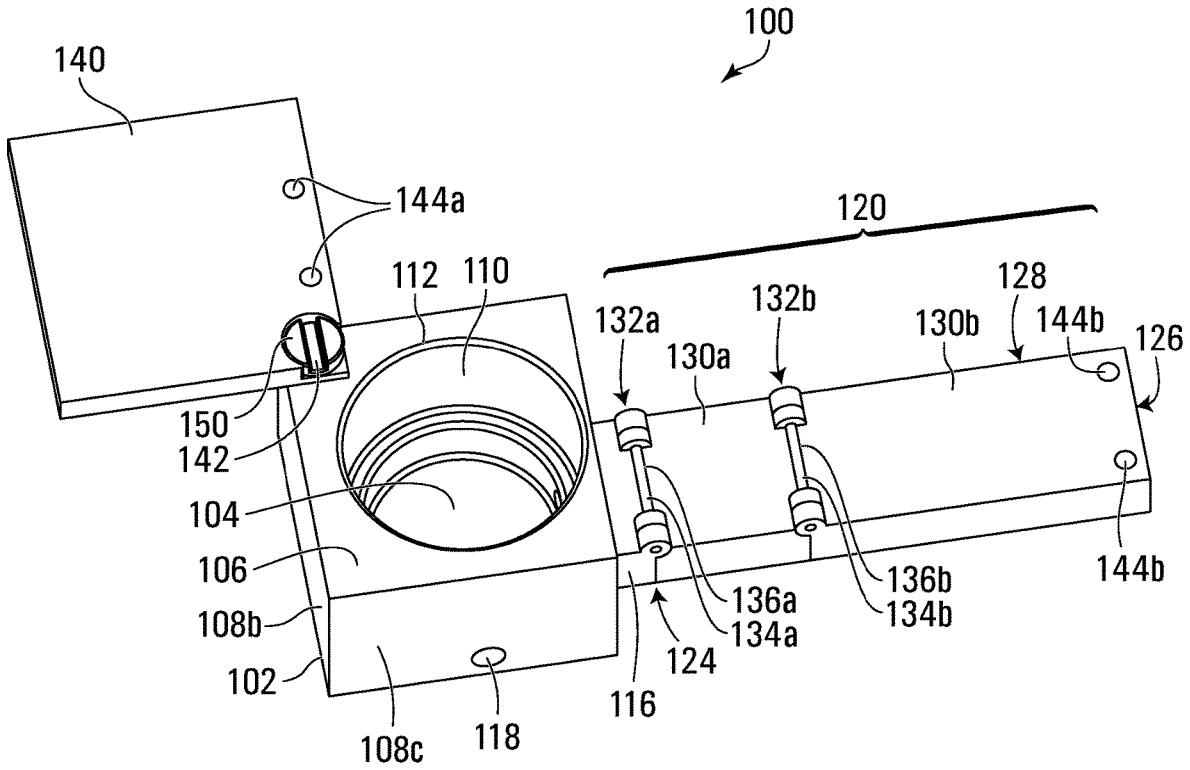
FIG. 1 is a perspective view of a smoking pipe, showing a stem assembly in an extended position.

An example of a smoking pipe 100 will be described with reference to FIGS. 1 to 6. As shown in FIG. 1, the smoking pipe 100 in this embodiment comprises a base 102 and a collapsible stem assembly 120.

Figure 4:
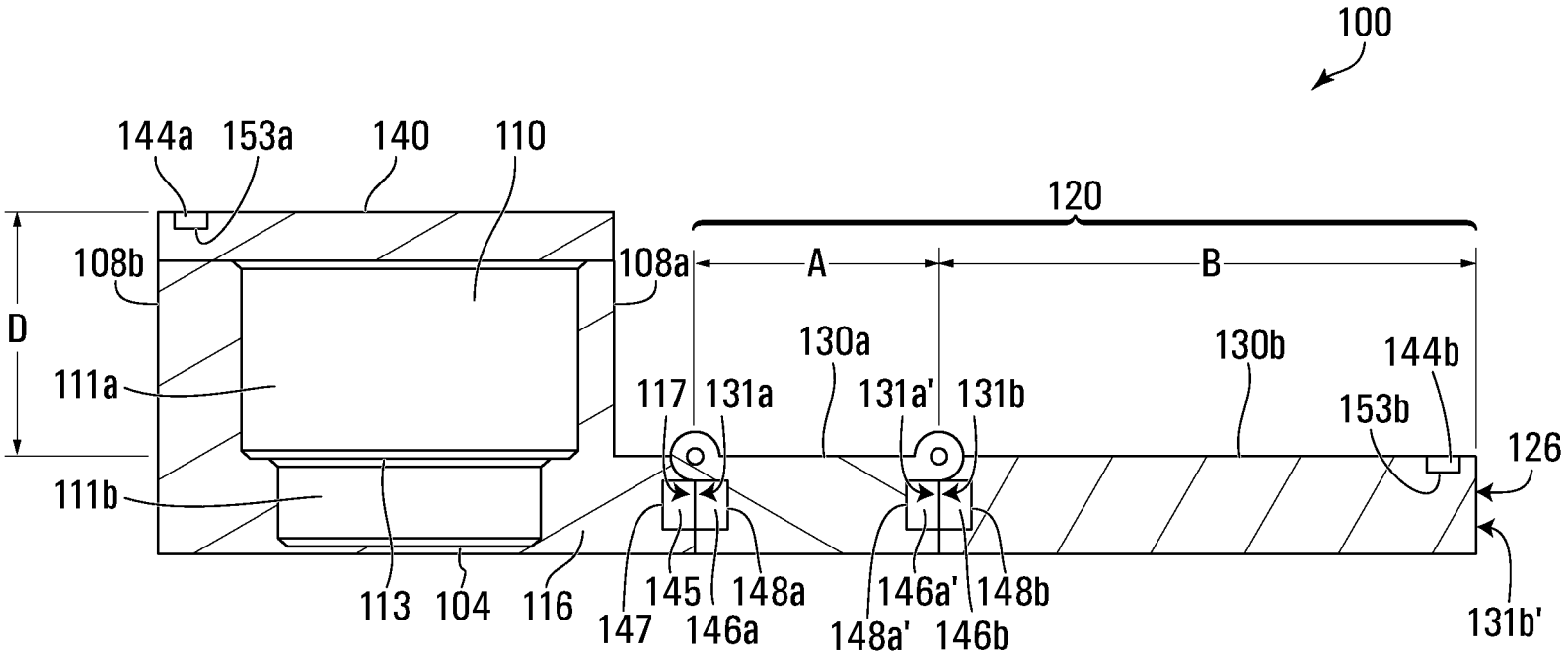
FIG. 4 is a side, cross-sectional view of the smoking pipe of FIG. 1, showing the stem assembly in an extended position.

The base 102 in this embodiment is approximately a cuboid shape. In other embodiments, the base 102 may be any other suitable shape, for example, an approximately cylindrical shape. The base 102 may comprise an open chamber 110 configured to hold a smoking material (not shown) for smoking. In some embodiments, the chamber 110 is approximately cylindrical or frustoconical. As shown in FIG. 4, in some embodiments, the chamber 110 has a first (upper) portion 111*a* and a second (lower) portion 111*b*, the first portion 111*a* having a larger diameter than the second portion 111*b*. A ridge 113 may be formed between the first portion 111*a* and the second portion 111*b*. In this embodiment, a glass bowl (not shown) may be received in the first portion 111*a* and rest atop the ridge 113. The second portion 111*b* may remain empty to facilitate movement of smoke from the smoking material into the stem assembly 120. In other embodiments, the chamber 110 may be any other suitable shape to hold a smoking material. In some embodiments, the smoking material is a plant material. In some embodiments, the plant material is tobacco.

Figure 5:
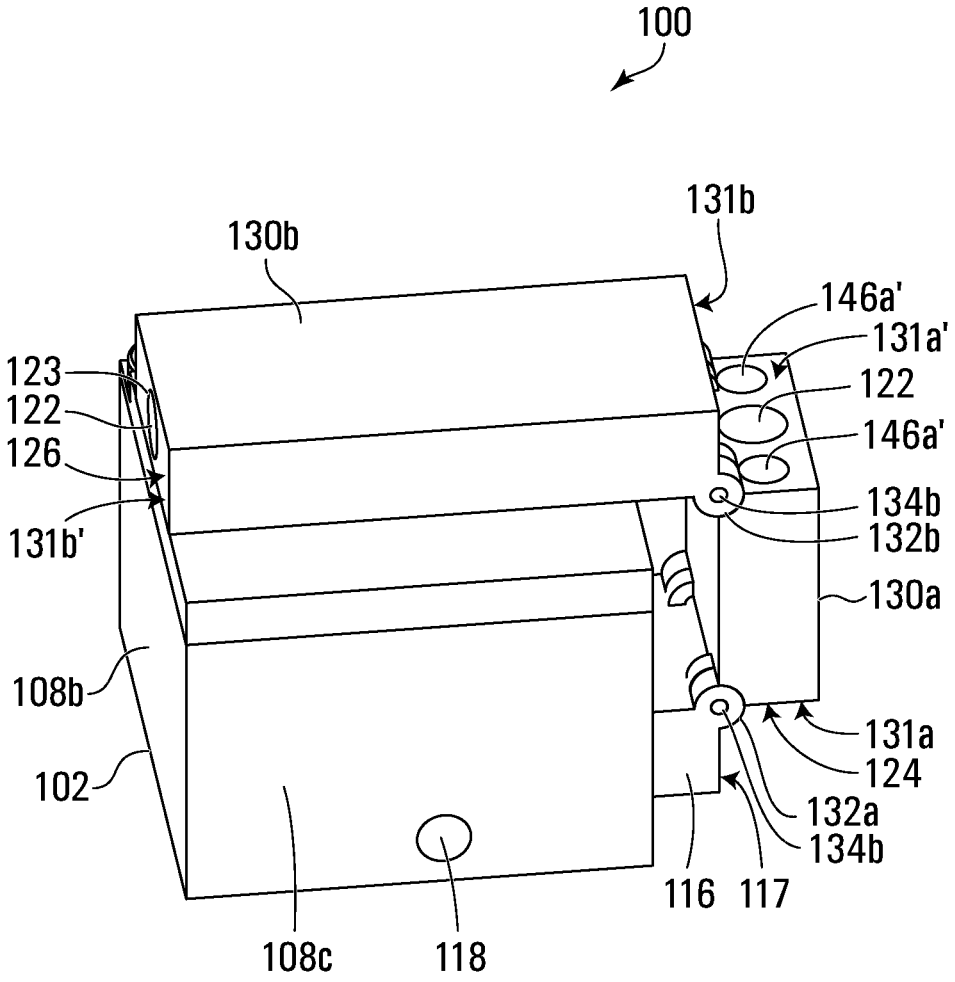
FIG. 5 is a perspective view of the smoking pipe of FIG. 1, showing the stem assembly in a collapsed position.

The stem assembly 120 may define a longitudinal conduit 122 therethrough (the longitudinal conduit 122 is visible in FIG. 5). In some embodiments, the stem assembly 120 has an approximately rectangular profile. In some embodiments, the longitudinal conduit 122 is approximately cylindrical. In other embodiments, the stem assembly 120 and longitudinal conduit 122 are any other suitable shapes.

The stem assembly 120 in this embodiment has an extended position as shown in FIG. 1. As used herein, the "extended position", when used in reference to the stem assembly 120, refers to a position in which the stem assembly 120 extends away from the base. In the extended position, the longitudinal conduit 122 of the stem assembly 120 may be in fluid communication with the chamber 110 of the base 102. When the stem assembly 120 is in the extended position, the smoking pipe 100 may be used by the user for smoking the smoking material held in the chamber 110.

The stem assembly 120 in this embodiment also has a collapsed position (as shown in FIG. 5). As used herein, the "collapsed position", when used in reference to the stem assembly 120, refers to a position in which the stem assembly 120 is collapsed towards the base 102. When the stem assembly 120 is in the collapsed position, the smoking pipe 100 may be in a more compact form and may be more discreet and/or comfortable to store or transport. For example, the smoking pipe 100 may fit within a user's pocket when the stem assembly 120 is in the collapsed position.

Figure 2:
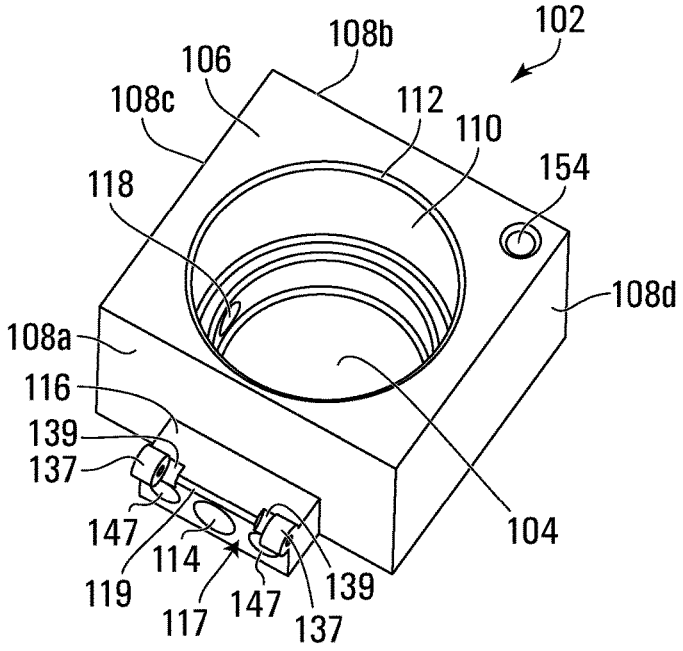
FIG. 2 is a perspective view of the base of the smoking pipe of FIG. 1.

Referring now to FIG. 2, the base 102 of the smoking pipe 100 may comprise a bottom face 104, an opposed top face 106, opposed first and second side faces 108*a* and 108*b*, and opposed third and fourth side faces 108*c* and 108*d*.

The top face 106 of the base 102 may define an opening 112 to the chamber 110. In this embodiment, the opening 112 is a circular opening. In other embodiments, the opening 112 is any other suitable shape. The opening 112 may provide access for a user to light the smoking material held in the chamber 110. For example, the user may light the smoking material by contacting the smoking material with a flame from a lighter or a match via the opening 112.

The base 102 may comprise a ventilation channel 114 extending from the chamber 110 though the first side face 108*a* of the base 102. In this embodiment, an extension 116 projects from the first side face 108*a* and the ventilation channel 114 extends through the extension 116 to an outer face 117 thereof. In some embodiments, the extension 116 is approximately the same height and width as the stem assembly 120. The ventilation channel 114 of the extension 116 may align with the longitudinal conduit 122 of the stem assembly 120 when the stem assembly 120 is in the extended position.

In some embodiments, the base 102 may further comprise a carb hole 118 extending from the chamber 110 to the third side face 108*c* to allow airflow into the chamber 110. During smoking, the user may place a thumb or finger over the carb hole 118 as they inhale smoke from the smoking material in the chamber 110 and then release their thumb or finger to allow air to enter the chamber 110 and push any remaining smoke through the stem assembly 120.

Referring again to FIG. 1, the stem assembly 120 may comprise a first end 124 and an opposed second end 126. The first end 124 of the stem assembly 120 may be coupled to the base 102 proximate the ventilation channel 114 such that the longitudinal conduit 122 is aligned with the ventilation channel 114 when the stem assembly 120 is in the extended position. In this embodiment, the first end 124 of the stem assembly 120 is coupled to the extension 116 of the base 102.

When the stem assembly 120 is in the extended position, the second end 126 may be distal the base 102. In some embodiments, in the extended position, the stem assembly 120 may be substantially perpendicular to the first side face 108*a* of the base 102. The longitudinal conduit 122 may extend through the stem assembly 120 from the first end 124 to the second end 126 to form a suction opening 123 (the suction opening 123 is visible in FIG. 5) at the second end 126. The suction opening 123 may thereby be in fluid communication with the chamber 110 via the ventilation channel 114. During smoking, the user may place their mouth over the second end 126 of the stem assembly 120 to draw smoke from the smoking material held in the chamber 110. The smoke may thereby flow through the longitudinal conduit 122 and out of the suction opening 123 into the user's mouth and lungs for consumption.

In this embodiment, the second end 126 of the stem assembly 120 functions as a mouthpiece. In other embodiments, the stem assembly 120 further comprises a mouthpiece (not shown). The mouthpiece may be integral to the stem assembly 120 or coupled to the stem assembly 120 using any suitable coupling means. In some embodiments, the mouthpiece is removable and removably engages the stem assembly 120.

When the stem assembly 120 is in the collapsed position, the second end 126 of the stem assembly 120 may be proximate the base 102. In some embodiments, when the stem assembly 120 is in the collapsed position, the first end 124 of the stem assembly 120 is displaced from the extension 116 such that the longitudinal conduit 122 is no longer in fluid communication with the ventilation channel 114.

Figure 3A:
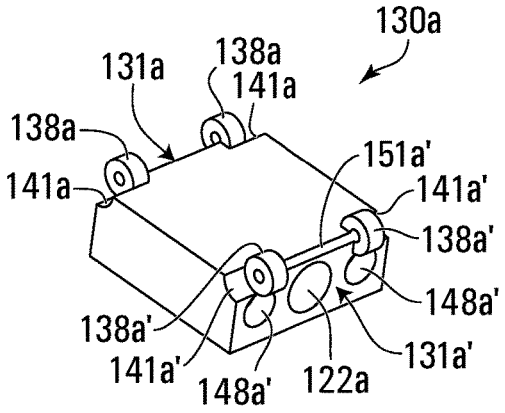
FIG. 3A is a perspective view of a first stem section of the smoking pipe of FIG. 1.
Figure 3B:
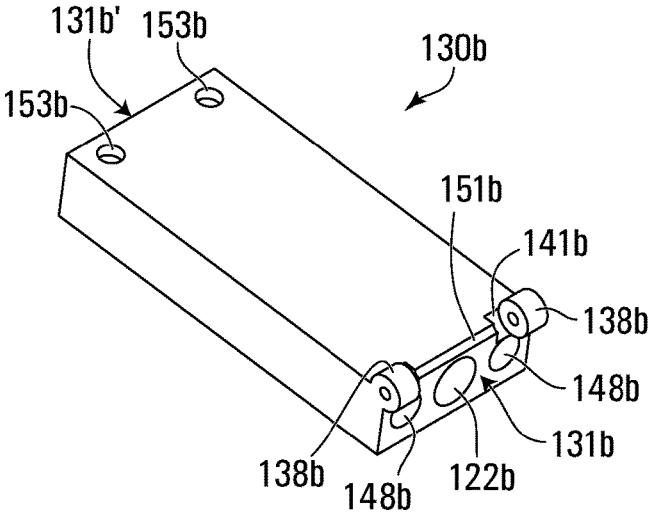
FIG. 3B is a perspective view of a second stem section of the smoking pipe of FIG. 1.

The stem assembly 120 may comprise at least two interconnected stem sections. The stem assembly 120 in this embodiment comprises a first stem section 130*a* and a second stem section 130*b*. As shown in FIGS. 3A and 3B, the first and second stem sections 130*a*, 130*b* may each define a respective portion 122*a*, 122*b* of the longitudinal conduit 122 therethrough.

The first stem section 130*a* may have a first end 131*a* and an opposed second end 131*a*'. The second stem section 130*b* may have a first end 131*b* and an opposed second end 131*b*'. The second end 131*a*' of the first stem section 130*a* may be coupled to the first end 131*b* of the second stem section 130*b*. Therefore, in this embodiment, the first end 131*a* of the first stem section 130*a* is the first end 124 of the stem assembly 120 and the second end 131*b*' of the second stem section 130*b* is the second end 126 of the stem assembly 120.

In the extended position, the first and second stem sections 130*a*, 130*b* may be arranged in an end-to-end formation such that the first end 131*a* of the first stem section 130*a* abuts the outer face 117 of the base 102 and the first end 131*b* of the second stem section 130*b* abuts the second end 131*a*' of the first stem section 130*a*. In some embodiments, the first and second pipe stem sections 130*a* and 130*b* may be substantially collinear when the stem assembly 120 is in the extended position. Further, in the extended position, the respective portions 122*a* and 122*b* of the longitudinal conduit 122 may be substantially aligned such that the longitudinal conduit 122 extends substantially continuously along the entire length of the stem assembly 120.

As shown in FIG. 1, the first stem section 130*a* may be rotatably coupled to the base 102 by a first articulating connection 132*a*. The second stem section 130*b* may be rotatably coupled to the first stem section 130*a* by a second articulating connection 132*b*.

In this embodiment, the first and second articulating connections 132*a* and 132*b* comprise first and second hinges 134*a* and 134*b*, respectively. The first stem section 130*a* is rotatable relative to the base 102 about the first hinge 134*a* and the second stem section 130*b* is rotatable relative to the first stem section 130*a* about the second hinge 134*b*. Embodiments are not limited to hinge connections. In other embodiments, the first and second articulating connections may comprise bending couplers, flexible couplers, or any other suitable structures that allow the first stem section 130*a* to be rotatable relative to the base 102 and the second stem section 130*b* to be rotatable relative to the first stem section 130*a*.

The first hinge 134*a* may comprise a first hinge pin 136*a*. The base 102 and the first stem section 130*a* may each comprise at least one hinge barrel engaged by and axially aligned with the first hinge pin 136*a*. As used herein, the "hinge pin" refers to an approximately cylindrical rod that forms a pivot point of a hinge. As used herein, a "hinge barrel" refers to a component having an aperture therethrough that rotatably engages a hinge pin. A hinge barrel may also be known as a hinge knuckle, loop, joint, node, curl or any other term for a hinge component that rotatably engages a hinge pin.

As shown in FIG. 2, the base 102 in this embodiment comprises a pair of axially aligned and spaced apart hinge barrels on 137 on the outer face 117 of the extension 116. The hinge barrels 137 may be integral to the base 102 or may be coupled to the base 102 by any suitable coupling means.

As shown in FIG. 3A, the first stem section 130*a* in this embodiment comprises a pair of hinge barrels 138*a* axially aligned and spaced apart on the first end 131*a* of the first stem section 130*a*. The hinge barrels 138*a* may be integral to the first stem section 130*a* or may be coupled to the first stem section 130*a* using any suitable coupling means. In some embodiments, the hinge barrels 138*a* may be positioned on the first end 131*a* of the first stem section 130*a* to be adjacent to the hinge barrels 137 of the extension 116.

The outer face 117 of the extension 116 of the base 102 may define a groove 119 to provide clearance for the first hinge pin 136*a* and a pair of notches 139 to receive at least a portion of the hinge barrels 138*a* of the first stem section 130*a*. The first end 131*a* of the first stem section 130*a* may define a groove (not shown) to provide clearance for the first hinge pin 136*a* and a pair of notches 141*a* to receive at least a portion of the hinge barrels 137 of the base 102.

Therefore, the combination of the first hinge pin 136*a* and the hinge barrels 137 and 138*a* of the base 102 and the first stem section 130*a*, respectively, may thereby form the first hinge 134*a*.

The second hinge 134*a* may comprise a second hinge pin 136*b*. The first stem section 130*a* and the second stem section 130*b* may each comprise at least one hinge barrel engaged by and axially aligned with the first hinge pin 136*a*.

As shown in FIG. 3A, the first stem section 130*a* in this embodiment comprises a pair of hinge barrels 138*a*' axially aligned and spaced apart on the second end 131*a*' of the first stem section 130*a*. The hinge barrels 138*a*' may be integral to the first stem section 130*a* or may be coupled to the first stem section 130*a* using any suitable coupling means.

As shown in FIG. 3B, the second stem section 130*b* in this embodiment comprises a pair of hinge barrels 138*b* axially aligned and spaced apart on the first end 131*b* of the second stem section 130*b*. The hinge barrels 138*b* may be integral to the second stem section 130*b* or may be coupled to the second stem section 130*b* using any suitable coupling means. In some embodiments, the hinge barrels 138*b* may be positioned on the first end 131*b* of the second stem section 130*b* to be adjacent to the hinge barrels 138*a*' of the first stem section 130*a*.

The second end 131*a*' of the first stem section 130*a* may define a groove 151*a*' to provide clearance for the second hinge pin 136*b* and at least one notch 141*a*' to receive at least a portion of the hinge barrels 138*b* of the second stem section 130*b*. The first end 131*b* of the second stem section 130*b* may define a groove 151*b* to provide clearance for the second hinge pin 136*b* and a pair of notches 141*b* to receive at least a portion of the hinge barrels 138*a*' of the first stem section 130*a*.

The combination of the second hinge pin 136*b* and the hinge barrels 138*a*' and 138*b* of the first stem section 130*a* and the second stem section 130*b*, respectively, may thereby form the second hinge 134*b*.

The first and second hinges 134*a*, 134*b* may be disposed at or near an upper face 128 of the stem assembly 120 such that the first and second stem sections 130*a*, 130*b* may be rotated in an upward direction towards the base 102. In the extended position, the abuttal of the outer face 117 of the extension 116 to the first end 131*a* of the first stem section 130*a* and the abuttal of the second end 131*a*' of the first stem section 130*a* and the first end 131*b* of the second stem section 130*b* may stop the rotation of the first and second stem sections 130*a*, 130*b* in a downward direction when the stem assembly 120 is in the extended position. By preventing the stem assembly 120 from rotating in a downward direction, the stem assembly 120 may be maintained in the extended position when in use by the user for smoking.

To collapse the stem assembly 120, the first stem section 130*a* may be rotated upward about the first hinge 134*a* towards the base 102 and the second stem section 130*b* may be rotated about the second hinge 134*b* towards the base 102. In some embodiments, when the stem assembly 120 is in the collapsed position, the stem assembly is at least partially wrapped around the base. In this example, the first stem section 130*a* is substantially parallel to the first side face 108*a* of the base 102 and the second stem section 130*b* is substantially parallel to the top face 106 of the base 102 when the stem assembly 120 is in the collapsed position.

In some embodiments, the stem assembly 120 may be releasably held in the extended position, for example, when in use by the user for smoking. In some embodiments, the smoking pipe 100 comprises at least one magnet positioned to releasably hold the stem assembly 120 in the extended position. As used herein, "magnet" refers to an object made of a magnetized material that creates its own persistent magnetic field. In some embodiments, the material may be a ferromagnetic material. In some embodiments, the ferromagnetic material may be, for example, iron, nickel, cobalt, or alloys thereof. In other embodiments, the material may be any other material capable of being magnetized and embodiments are not limited to any particular magnetized material.

As shown in FIG. 4, the base 102 may comprise at least one base magnet 145. Each base magnet 145 may be received in a respective recess 147 in the outer face 117 of the extension 116. In this embodiment, two base magnets 145 are received in respective recesses 147 on either side of the ventilation channel 114. In other embodiments, any other suitable number of base magnets 145 may be received in respective recesses 147.

The first stem section 130*a* may comprise at least one first stem magnet 146*a*. The first stem magnet 146*a* may be received in a recess 148*a* in the first end 131*a* of the first stem section 130*a*. In this embodiment, two first stem magnets 146*a* are received in respective recesses 148*a* on either side of the longitudinal conduit 122. In other embodiments, any other suitable number of first stem magnets 146*a* may be received in respective recesses 148*a*. The first stem section 130*a* may further comprise at least one second stem magnet 146*a*'. The second stem magnet 146*a*' may be received in a recess 148*a*' in the opposed second end 131*a*' of the first stem section 130*a*. In this embodiment, two second stem magnets 146*a*' are received in respective recesses 148*a*' disposed on either side of the longitudinal conduit 122. In other embodiments, any other suitable number of second stem magnets 146*a*' may be received in respective recesses 148*a'*.

The second stem section 130*b* may comprise at least one stem magnet 130*b*. At least one stem magnet 146*b* may be received in a recess 148*b* in the first end 131*b* of the second stem section 130*b*. In this embodiment, two stem magnets 146*b* are received in respective recesses 148*b* on either side of the longitudinal conduit 122. In other embodiments, any other suitable number of stem magnets 146*b*' may be received in respective recesses 148*b*.

The base magnets 145 and the stem magnets 146*a*, 146*a*', 146*b* may be any suitable size and shape, for example, approximately disc-shaped or cylindrical. Embodiments are not limited to any particular magnet shape.

The base magnets 145 may be of opposite polarity to the first stem magnets 146*a* of the first stem section 130*a*. When the stem assembly 120 is in the extended position, the base magnets 145 and the first stem magnets 146*a* may be brought into proximity to generate a magnetic force therebetween to hold the first end 131*a* of the first stem section 130*a* to the outer face 117 of the extension 116.

The second stem magnets 146*a*' of the first stem section 130*a* may be of opposite polarity to the stem magnets 146*b* of the second stem section 130*b*. When the stem assembly 120 is in the extended position, the stem magnets 146*a*', 146*b* may be brought into proximity to generate a magnetic force therebetween to hold the first end 131*b* of the second stem section 130*b* to the second end 131*a*' of the first stem section 130*a*.

In other embodiments, the extension 116 at least partially comprises a magnetic material and the first stem section 130*a* comprises at least one magnet to magnetically attract the magnetic material, or vice versa. In other embodiments, one of the stem sections 130*a*, 130*b* at least partially comprises a magnetic material and the other one of the stem section 130*a*, 130*b* comprises at least one magnet. As used herein, "magnetic material" refers to a material that is attracted to a magnet but is not magnetized itself. In some embodiments, the material may be a ferromagnetic material, for example, iron, nickel, cobalt, or alloys thereof. In other embodiments, the material may be any other material capable of being attracted to a magnet and embodiments are not limited to any particular magnetic material.

The strength of the base magnets 145 and the stem magnets 146*a*, 146*a*', 146*b* may be such that the magnetic forces that hold the stem assembly 120 in the extended position may be overcome by the user to collapse the stem assembly 120 into the collapsed position as described above.

Therefore, in some embodiments, the stem assembly 120 is held in the extended position in a releasable manner. Holding the stem assembly 120 in the extended position may prevent loss of the fluid connection between the chamber 110 of the base 102 and the suction opening 123 of the stem assembly 120, thereby facilitating smoking by the user.

As shown in FIGS. 1 and 4, in some embodiments, the smoking pipe 100 further comprises a cover member 140 that engages the base 102 to cover the opening 112 of the chamber 110. In some embodiments, the cover member 140 is attached to the base 102. In other embodiments, the cover member 140 is removable and removably engages base 102 to cover the opening 112 of the chamber 110.

In some embodiments, the cover member 140 is pivotably attached to the base 102. The cover member 140 may be pivotable between an open position as shown in FIG. 1 and a covering position as shown in FIG. 5. As used herein, "open position" refers to a position of the cover member 140 in which cover member 140 is pivoted away from the base 102 such that the opening 112 to the chamber 110 is uncovered. When the cover member 140 is in the open position, the smoking pipe 100 may be used by the user for smoking. Also when the cover member 140 is in the open position, the chamber 110 is accessible to the user for loading and lighting the smoking material or removing ash. As used herein, "covering position" refers to a position of the cover member 140 in which the cover member 140 covers the opening 112 to the chamber 110. When the cover member 140 is in the covering position, and the stem assembly 120 is in the collapsed position, the smoking pipe 100 may be suitable for storage or transport.

Figure 6A:
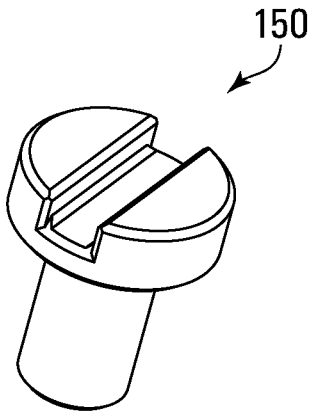
FIG. 6A is a perspective view of a fastener of the smoking pipe of FIG. 1.
Figure 6B:
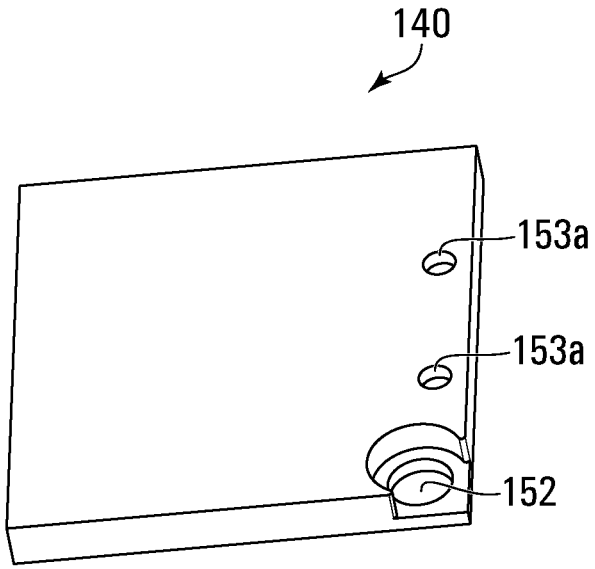
FIG. 6B is a perspective view of a cover member of the smoking pipe of FIG. 1.

The cover member 140 may be pivotably attached to the base 102 by a coupling mechanism 142. In some embodiments, the coupling mechanism 142 comprises a fastener 150 as shown in FIG. 6A. In this embodiment, the fastener 150 comprises a screw. In other embodiments, the fastener 150 comprises any other suitable type of fastener. The fastener 150 may be received through an aperture 152 extending through one corner of the cover member 140 (as shown in FIG. 6B) and into a recess 154 in the base 102 (as shown in FIG. 2). The aperture 152 in the cover member 140 may be a suitable diameter to provide a clearance fit with the fastener 150 such that the cover member 140 may be pivoted about the fastener 150. In other embodiments, the cover member 140 may be pivotably attached to the base 102 using a hinge or any other suitable coupling mechanism that allows the cover member 140 to pivot relative to the base.

As shown in FIG. 4, in some embodiments, the first stem section 130*a* has a length A and the second stem section has a length B. The length A of the first stem section 130*a* may be approximately the same as the distance D between the extension 116 and the top of the cover member 140 such that the second end 131*a*' of the first stem section 130*a* is approximately level with the top of the cover member 140 when the stem assembly 120 is in the collapsed position. Therefore, when the stem assembly 120 is in the collapsed position, the second stem section 130*b* may extend along the top of the cover member 140. The length B may be selected such that at least a portion of the second stem section 130*b* is in contact with the cover member 140 when the stem assembly 120 is in the collapsed position. In some embodiments, the length B may be greater than the length A.

In some embodiments, the stem assembly 120 may be releasably secured in the collapsed position. In some embodiments, the smoking pipe 100 comprises at least one securing magnet positioned to magnetically engage the stem assembly 120 with the base 102 or the cover member 140 when the stem assembly 120 is in the collapsed position. The securing magnets may be similar in structure to the base magnets 145 and the stem magnets 146*a*, 146*a*', 146*b*, as described above.

As shown in FIGS. 1 and 4, the cover member 140 may comprise at least one first securing magnet 144*a* and the second stem section 130*b* of the stem assembly 120 may comprise at least one second securing magnet 144*b*. In this embodiment, the cover member 140 comprises two first securing magnets 144*a* and the second stem section 130*b* comprises two second securing magnets 144*b*. In other embodiments, any other suitable number of securing magnets 144*a*, 144*b* may be provided. Each of the first and second securing magnets 144*a*, 144*b* may be received in respective recesses 153*a*, 153*b* in the cover member 140 and the second stem section 130*b*, respectively (recesses 153*a*, 153*b* can be seen in FIG. 4).

The first securing magnets 144*a* may be of opposite polarity to the second securing magnets 144*b*. When the stem assembly 120 is in the collapsed position, the first and second securing magnets 144*a* and 144*b* may be brought into proximity, thereby allowing a magnetic force to be generated therebetween to hold the second stem section 130*b* to the cover member 140.

The first securing magnets 144*a* may be at any position on the cover member 140 such that the second securing magnets 144*b* are brought into proximity to the first securing magnets 144*a* when the stem assembly 120 is in the collapsed position. In some embodiments, at least one second securing magnet 144*b* is positioned proximate the second end 126 of the stem assembly 120. In other embodiments, the second securing magnets 144*b* may be at any position on the second stem section 130*b* at which the second stem section 130*b* is in contact with the cover member 140 when the stem assembly 120 is in the collapsed position.

In other embodiments, the cover member 140 comprises a magnetic material and the second stem section 130*b* comprises at least one securing magnet to attract the magnetic material when the stem assembly 120 is in the collapsed position. In other embodiments, the second stem section 130*b* comprises a magnetic material and the cover member 140 comprises at least one magnet.

The strength of the securing magnets 144*a*, 144*b* may be such that the magnetic force that secures the stem assembly 120 to the cover member 140 may be overcome by the user to release the stem assembly 120 from the cover member 140 when needed.

Therefore, in some embodiments, securing the stem assembly 120 to the cover member 140 holds the stem assembly 120 in the collapsed position in a releasable manner. Securing the stem assembly 120 in the collapsed position may facilitate storage or transport of the smoking pipe 100, even if the smoking pipe 100 is agitated or dropped. In some embodiments, securing the stem assembly 120 to the cover member 140 may also prevent the cover member 140 from inadvertently pivoting to the open position and thereby preventing spillage of smoking material or ash contained within the chamber 110.

Figure 7:
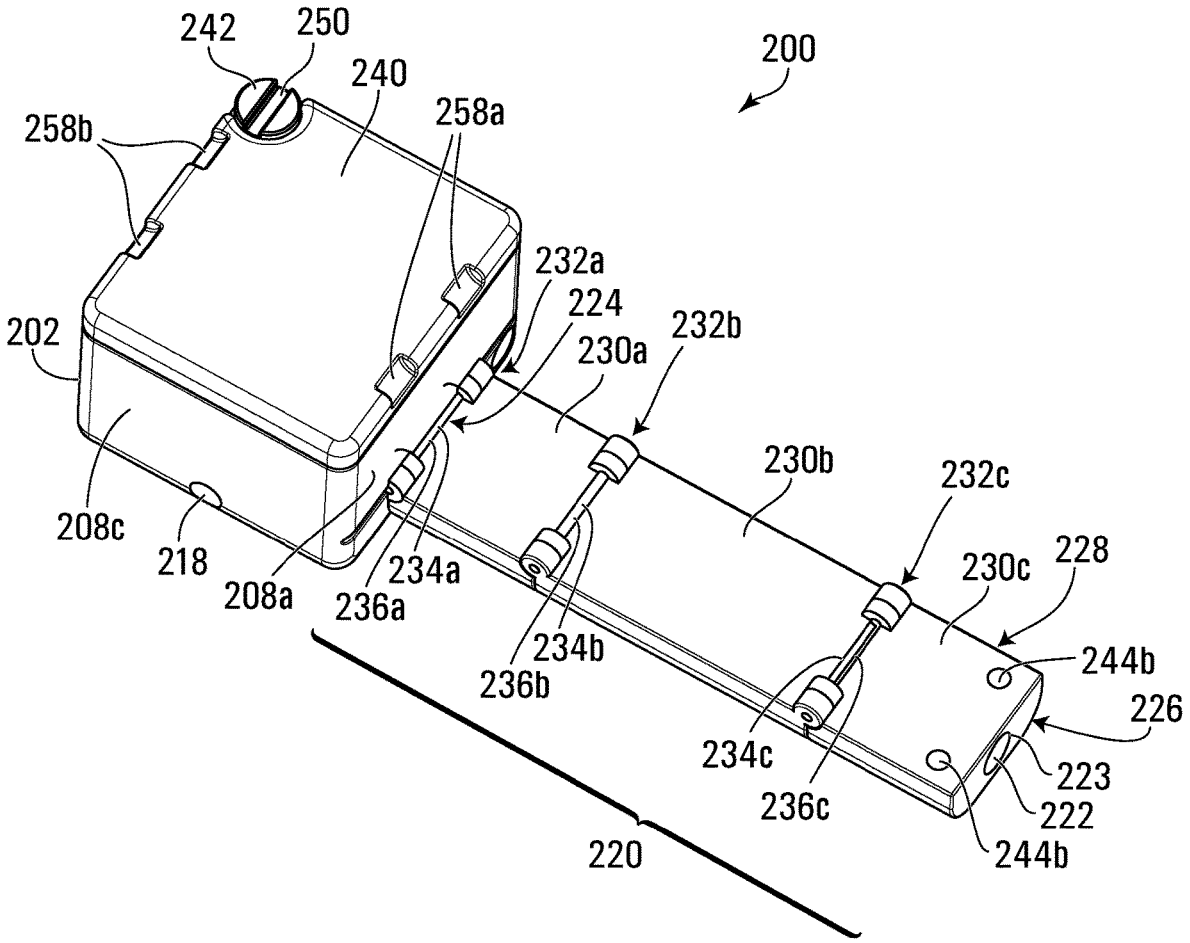
FIG. 7 is a perspective view of another smoking pipe, showing a stem assembly in an extended position.

A second example of a smoking pipe 200 will now be described with reference to FIGS. 7 to 12. As shown in FIG. 7, the smoking pipe 200 in this embodiment comprises a base 202 and a stem assembly 220. The base 202 may comprise an open chamber 210 and the stem assembly 220 may comprise a longitudinal conduit 222 therethrough.

Figure 12A:
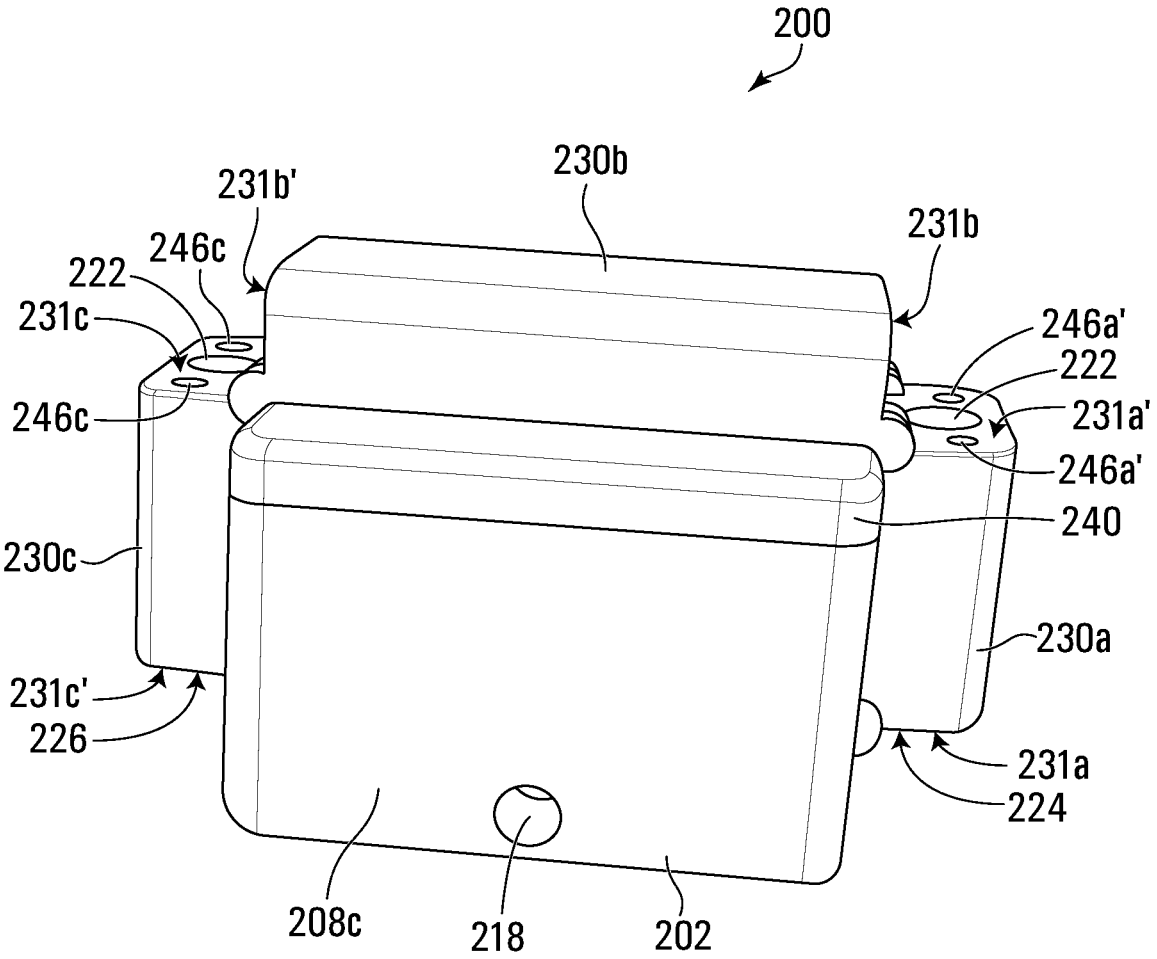
FIG. 12A is a perspective view of the smoking pipe of FIG. 7, showing the stem assembly in a collapsed position.
Figure 12B:
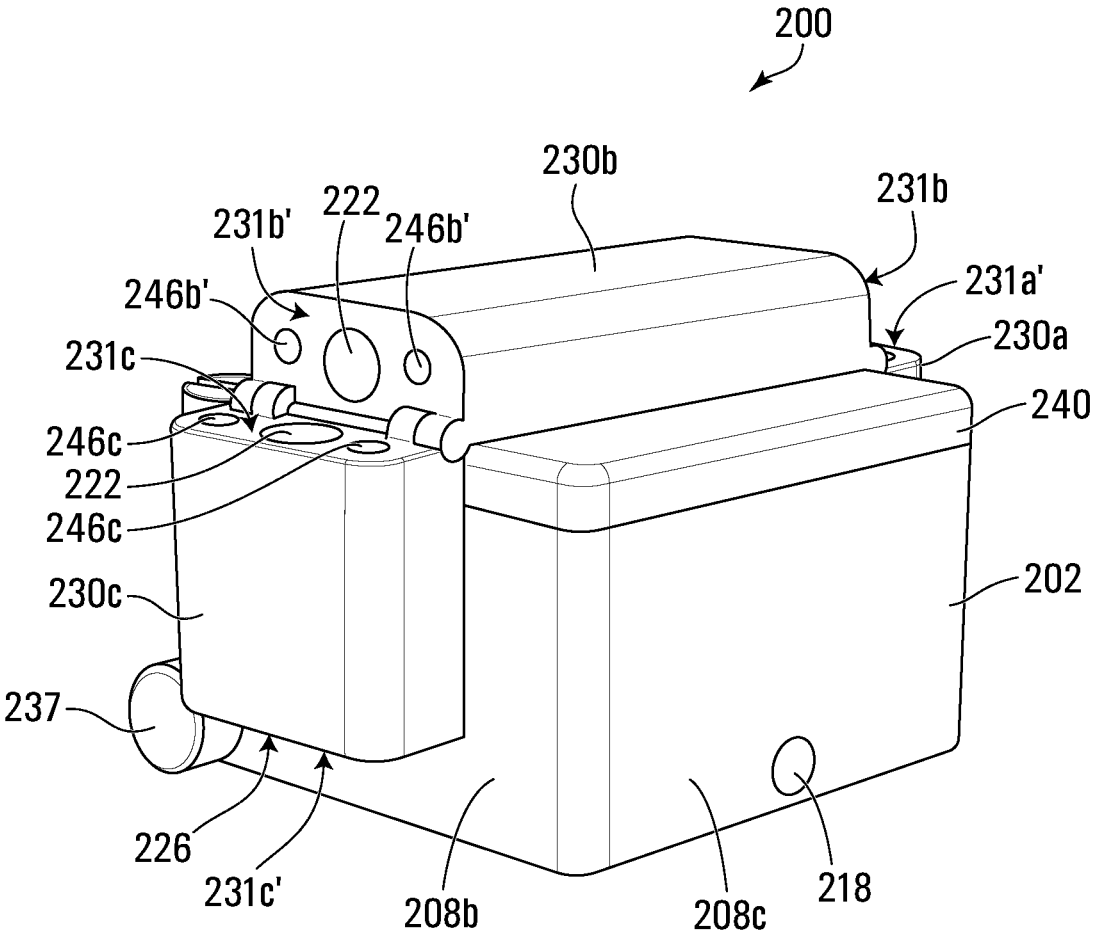
FIG. 12B is a perspective view of the smoking pipe of FIG. 7, showing the stem assembly in a collapsed position.

The stem assembly 220 in this embodiment has an extended position in which the stem assembly 220 extends away from the base 202 (as shown in FIG. 7) and a collapsed position in which the stem assembly 220 is collapsed towards the base (as shown in FIGS. 12A and 12*b*).

Figure 8:
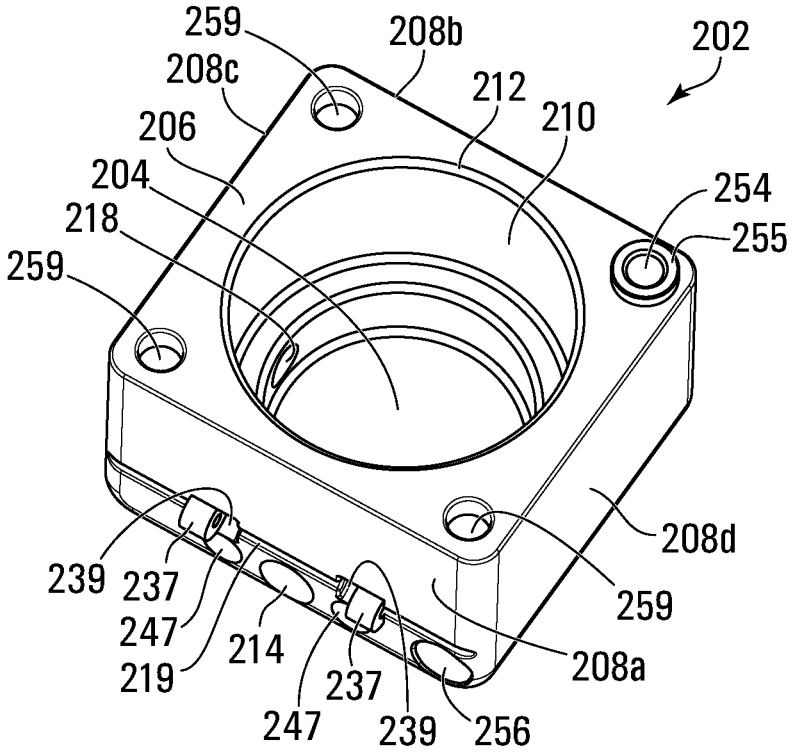
FIG. 8 is a perspective view of the base of the smoking pipe of FIG. 7.

As shown in FIG. 8, the base may comprise a bottom face 204, an opposed top face 206, opposed first and second side faces 208*a* and 208*b*, and opposed third and fourth side faces 208*c* and 208*d*. The top face 206 of the base 202 may comprise an opening 212 to the chamber 210. The base 202 may comprise a ventilation channel 214 extending from the chamber 210 to the first side face 208*a*.

In some embodiments, the base 202 may further comprise a carb hole 218 extending from the chamber 210 to the third side face 208*c*. In some embodiments, the base 202 may further comprise an elongate storage chamber 256 extending through the body 202 from the first side face 208*a* to the opposed second side face 208*b*. The storage chamber 256 may be used to store a pick 257 (the head of the pick 257 can be seen in FIG. 12B). The user may remove the pick 257 from the storage chamber 256 and use the pick 257 to clear ash or residue from the longitudinal conduit 122 if needed. The pick 257 may then be stored in the storage chamber 256. In other embodiments, the storage chamber 256 may be used to store any other suitable tool for the smoking pipe 200.

Referring again to FIG. 7, the stem assembly 220 may comprise a first end 224 and an opposed second end 226. The first end 224 of the stem assembly 220 in this embodiment is coupled to the first side face 208*a* of the base 202 proximate the ventilation channel 214 such that the longitudinal conduit 222 is aligned with the ventilation channel 214 when the stem assembly 220 is in the extended position. When the stem assembly 220 is in the extended position, the second end 226 may be distal the base 202. The longitudinal conduit 222 may extend through the stem assembly 220 from the first end 224 to the second end 226 to form a suction opening 223 at the second end 226. The suction opening 223 may therefore be in fluid communication with the chamber 210 via the ventilation channel 214.

Figure 10A:
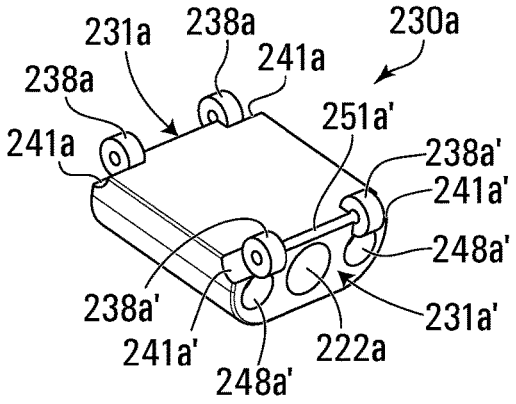
FIG. 10A is a perspective view of a first stem section of the smoking pipe of FIG. 7.
Figure 10B:
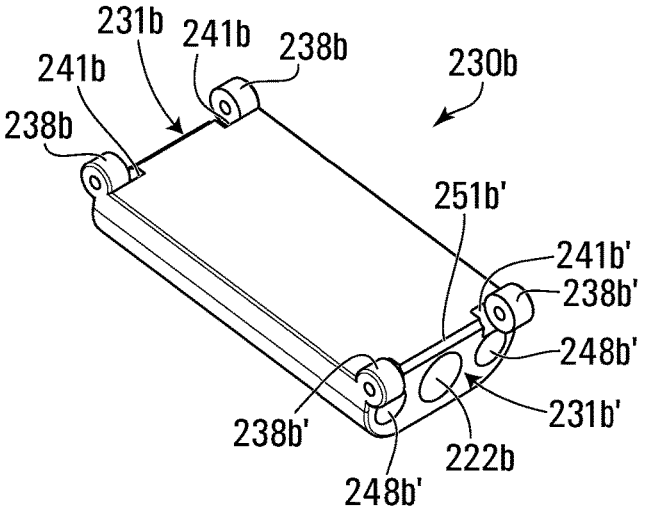
FIG. 10B is a perspective view of a second stem section of the smoking pipe of FIG. 7.
Figure 10C:
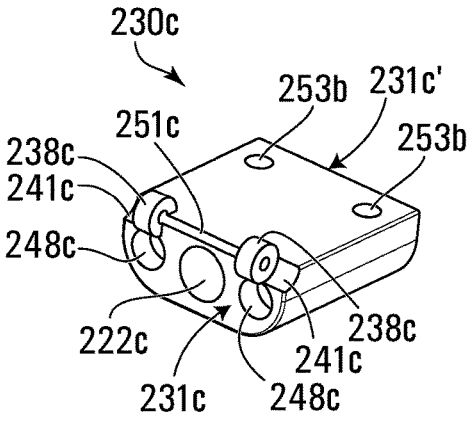
FIG. 10C is a perspective view of a third stem section of the smoking pipe of FIG. 7.

The stem assembly 220 in this embodiment comprises a first stem section 230*a*, a second stem section 230*b*, and a third stem section 230*c*. As shown in FIGS. 10A to 10C, each of the stem sections 230*a*, 230*b*, 230*c* may define respective portions 222*a*, 222*b*, 222*c* of the longitudinal conduit 222 therethrough.

The first stem section 230*a* may have a first end 231*a* and an opposed second end 231*a*'; the second stem section 230*b* may have a first end 231*b* and an opposed second end 231*b*'; and the third stem section 230*c* may have a first end 231*c* and an opposed second end 231*c*'. When the stem assembly 220 is in the extended position, the stem sections 230*a*, 230*b*, 230*c* may be arranged in an end-to-end formation such that the first end 231*a* of the first stem section 230*a* abuts the first side face 208*a* of the base 202, the first end 231*b* of the second stem section 230*b* abuts the second end 231*a*' of the first stem section 230*a*, and the first end 231*c* of the third stem section 230*c* abuts the second end 231*b*' of the second stem section 230*b*. Therefore, in this embodiment, the first end 231*a* of the first stem section 230*a* is the first end 224 of the stem assembly 220 and the second end 231*c*' of the third stem section 230*c* is the second end 226 of the stem assembly 220.

The first stem section 230*a* may be rotatably coupled to the base 202 by a first articulating connection 232*a*; the second stem section 230*b* may be rotatably coupled to the first stem section 230*a* by a second articulating connection 232*b*; and the third stem section 230*c* may be rotatably coupled to the second stem section 230*b* by a third articulating connection 232*c*. In this embodiment, the first, second, and third articulating connections 232*a*, 232*b*, 232*c* comprise first, second, and third hinges 234*a*, 234*b*, 234*c*, respectively.

The first hinge 234*a* may comprise a first hinge pin 236*a*. The base 202 and the first stem section 230*a* may each comprise at least one hinge barrel engaged by and axially aligned with the first hinge pin 236*a*. As shown in FIG. 8, the base 202 in this embodiment comprises a pair of hinge barrels 237 axially aligned and spaced apart on the first side face 208*a* of the base 202. As shown in FIG. 10A, the first stem section 230*a* in this embodiment comprises a pair of hinge barrels 238*a* axially aligned and spaced apart on the first end 231*a* of the first stem section 230*a*.

The first side face 208*a* of the base 202 may define a groove 219 to provide clearance for the first hinge pin 236*a* and a pair of notches 239 to receive at least a portion of the hinge barrels 238*a* of the first stem section 230*a*. The first end 231*a* of the first stem section 230*a* may define a groove (not shown) to provide clearance for the first hinge pin 236*a* and a pair of notches 241*a* to receive at least a portion of the hinge barrels 237 of the base 202.

Therefore, the combination of the first hinge pin 236*a* and the hinge barrels 237 and 238*a* of the base 202 and the first stem section 230*a*, respectively, may thereby form the first hinge 234*a*.

The second hinge 234*b* may comprise a second hinge pin 236*b*. The first and second stem sections 230*a* and 230*b* may each comprise at least one hinge barrel engaged by and axially aligned with the second hinge pin 236*b*. As shown in FIG. 10A, the first stem section 230*a* in this embodiment comprises a pair of hinge barrels 238*a*' axially aligned and spaced apart on the second end 231*a*' of the first stem section 230*a*. As shown in FIG. 10B, the second stem section 230*b* in this embodiment comprises a pair of hinge barrels 238*b* axially aligned and spaced apart on the first end 231*b* of the second stem section 230*b*.

The second end 231*a*' of the first stem section 230*a* may define a groove 251*a*' to provide clearance for the second hinge pin 236*b* and a pair of notches 241*a*' to receive at least a portion of the hinge barrels 238*b* of the second stem section 230*b*. The first end 231*b* of the second stem section 230*b* may define a groove (not shown) to provide clearance for the second hinge pin 236*b* and a pair of notches 241*b* to receive at least a portion of the hinge barrels 238*a*' of the first stem section 230*a*.

The combination of the second hinge pin 236*b* and the hinge barrels 238*a*', 238*b* of the first and second stem sections 230*a*, 230*b*, respectively, may thereby form the second hinge 234*b*.

The third hinge 234*c* may comprise a third hinge pin 236*c*. The second and third stem sections 230*b* and 230*c* may each comprise at least one hinge barrel engaged by and axially aligned with the third hinge pin 236*c*. As shown in FIG. 10B, the second stem section 230*b* in this embodiment comprises a pair of hinge barrels 238*b*' axially aligned and spaced apart on the second end 231*b*' of the second stem section 230*b*. As shown in FIG. 10C, the third stem section 230*c* in this embodiment comprises a pair of hinge barrels 238*c* axially aligned and spaced apart on the first end 231*c* of the third stem section 230*c*.

The second end 231*b*' of the second stem section 230*b* may define a groove 251*b*' to provide clearance for the third hinge pin 236*c* and a pair of notches 241*b*' to receive at least a portion of the hinge barrels 238*c* of the third stem section 230*c*. The first end 231*c* of the third stem section 230*c* may define a groove 251*c* to provide clearance for the third hinge pin 236*c* and a pair of notches 241*c* to receive at least a portion of the hinge barrels 238*b*' of the second stem section 230*b*.

The combination of the third hinge pin 236*c* and the hinge barrels 238*b*', 238*c* of the second and third stem sections 230*b*, 230*c*, respectively, may thereby form the third hinge 234*c*.

The first, second, and third hinges 234*a*, 234*b*, and 234*c* may be disposed at or near an upper surface 228 of the stem assembly 220 such that the stem sections 230*a*, 230*b*, 230*c* may be rotated in an upward direction towards the base 202 but not in a downward direction when the stem assembly 220 is in the extended position, similar to stem assembly 120 as discussed above.

To collapse the stem assembly 220, the first stem section 230*a* may be rotated upward about the first hinge 234*a* towards the base 202. The second stem section 230*b* may be rotated about the second hinge 234*b* towards the base 202 and the third stem section 230*c* may be rotated about the third hinge 234*c* towards the base. In this example, when the stem assembly 220 is in the collapsed position, the first and third stem sections 230*a*, 230*b* are substantially parallel to the opposed first and second side faces 208*a*, 208*b* of the base 202, and the second stem section 230*b* extends across and is substantially parallel to the top face 206.

Figure 11:
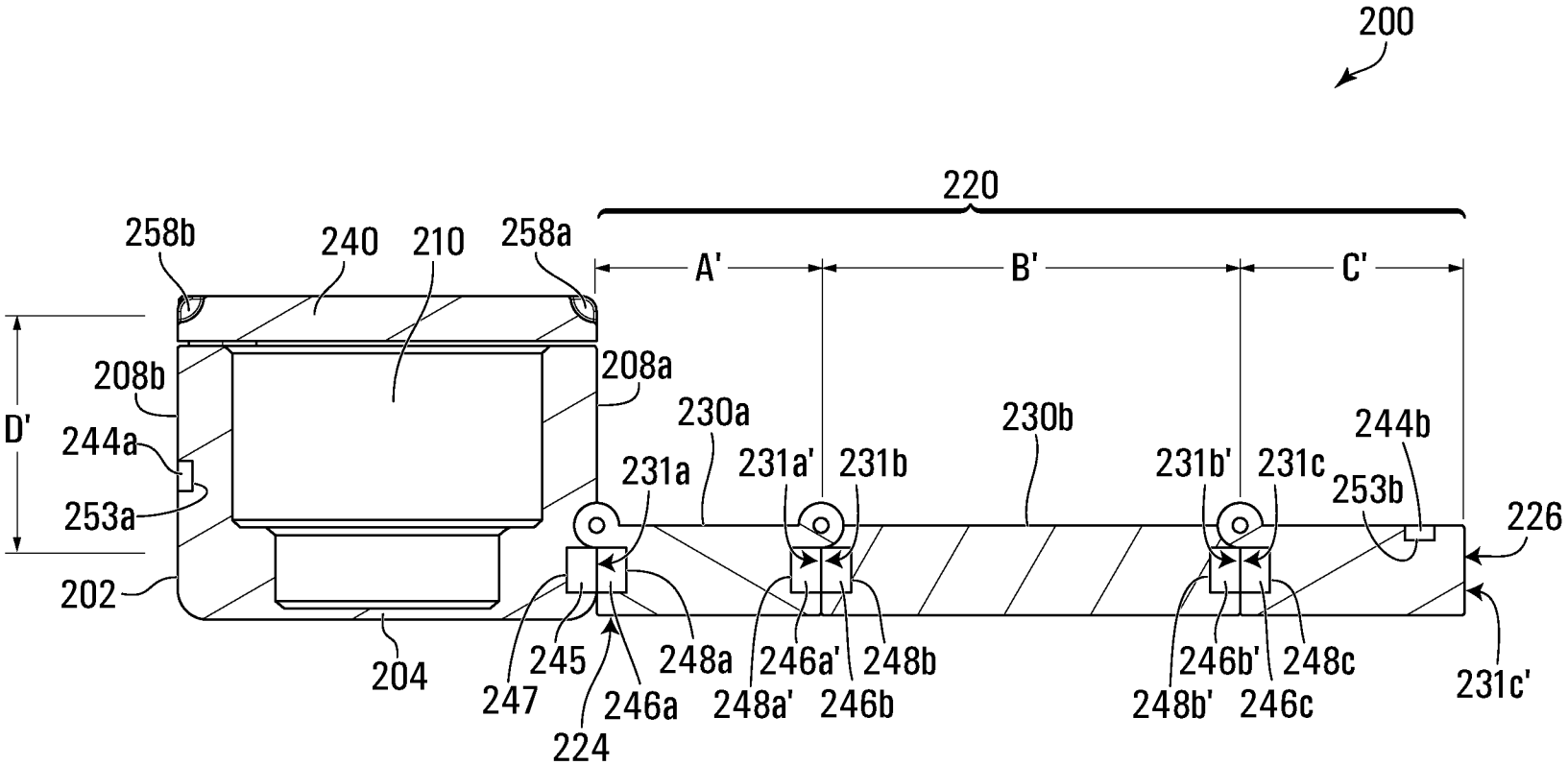
FIG. 11 is a side, cross-sectional view of the smoking pipe of FIG. 7, showing the stem assembly in the extended position.

The smoking pipe 200 may comprise at least one magnet positioned to releasably hold the stem assembly 220 in the extended position. As shown in FIG. 11, the base 202 in this embodiment comprises base magnets 245 received in respective recesses 247 in the first side face 208*a* of the base 202. The first stem section 230*a* may comprise stem magnets 246*a*, 246*a*' received in respective recesses 248*a*, 248*a*' in the first and second ends 231*a*, 231*a*' of the first stem section 230*a*, respectively. The second stem section 230*b* may comprise stem magnets 246*b*, 246*b*' received in respective recesses in the first and second ends 231*b*, 231*b*' of the second stem section 230*b*, respectively. The third stem section 230*c* may comprise stem magnets 246*c* in the first end 231*c* of the third stem section 230*c*. The stem assembly 220 may be releasably held in the extended position in a similar manner to stem assembly 120 of FIG. 1 as described above.

Figure 9:
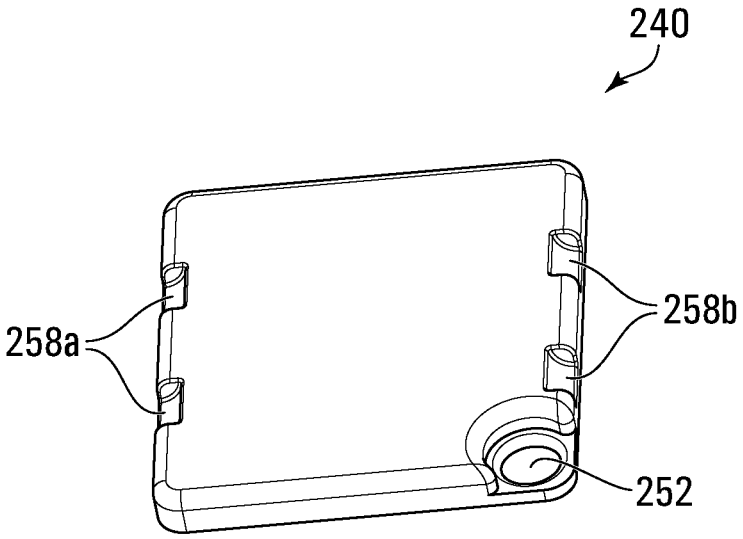
FIG. 9 is a perspective view of a cover member of the smoking pipe of FIG. 7.

Referring again to FIG. 7, the smoking pipe 200 may further comprise a cover member 240 that engages the base 202 to cover the opening 212 to the chamber 210 when the smoking pipe 200 is not in use. The cover member 240 may have an open position and a covering position. The cover member 240 may be pivotably attached to the base 202 by a coupling mechanism 242. The coupling mechanism 242 may comprise a fastener 250 similar to the fastener 150 in FIG. 6A as described above. The fastener 250 may be received through an aperture 252 in a corner of the cover member 250 (as shown in FIG. 9) and into a recess 254 in the base 202 (as shown in FIG. 8). In some embodiments, a nut or spacer 255 is provided in the recess 254 for receiving the fastener 250.

As shown in FIG. 8, in some embodiments, the top face 206 of the base 202 defines at least one recess 259 to receive a magnet (not shown). In this embodiment, three recesses 259 are provided to receive respective magnets. The magnets may magnetically engage the cover member 240 with the top face 206 of the base 202 when the cover member 240 is in the covering position. The cover member may thereby be releasably secured in the covering position when the smoking pipe 200 is not in use. In some embodiments, when the cover member 240 is in the open position, one or more magnets in the top face 206 proximate the coupling mechanism 242 may magnetically engage the cover member 240 with one side of the top face 206 of the base 202. The cover member 240 may thereby be releasably secured in the open position to prevent movement of the cover member 240 when the smoking pipe 200 is in use.

As shown in FIG. 11, in some embodiments, the first stem section 230*a* has a length A', the second stem section 230*b* has a length B', and the third stem section 230*c* has a length C'. The length A' of the first stem section 230*a* may be approximately equal to distance D' between the first hinge 234*a* and the top of the cover member 240 such that the second end 231*a*' of the first stem section 230*a* is approximately level with the top of the cover member 240 when the stem assembly 220 is in the collapsed position. Therefore, when the stem assembly 220 is in the collapsed position, the second stem section 230*b* may be extend across the top of the cover member 240. The length B' of the second stem section 230*b* may be selected such that the second stem section 230*b* is approximately the same length as the cover member 240. When the stem assembly 220 is in the collapsed position, the second end 231*b* of the second stem section 230*b* may therefore be approximately aligned with the second side face 208*b* of the base 202. Thus, the third stem section 230*c* may extend along the second side face 208*b* of the base 202 when the stem assembly 220 is in the collapsed position. In some embodiments, the length C' of the third stem section 230*c* is approximately the same as the length A' of the first stem section 230*a*. In other embodiments, length C' is different than length A'.

In some embodiments, the cover member 240 is configured to provide clearance for at least a portion of the stem assembly 220 when the stem assembly 220 is in the collapsed position. As shown in FIG. 9, the cover member 240 may comprise at least one notch to provide clearance for at least one articulating connection 232*a*, 232*b*, 232*c* when the stem assembly 220 is in the collapsed position. In this embodiment, the cover member 240 comprises a first pair of notches 258*a* to provide clearance for the hinge barrels 238*a*' and 238*b* of the second hinge 234*b*. The cover member 240 may further comprise a second pair of notches 258*b* to provide clearance for the hinge barrels 238*b*' and 238*c* of the third hinge 234*c*.

Therefore, when the stem assembly 220 is in the collapsed position, the second stem section 230*b* may be substantially flush with the cover member 240. The first and third stem sections 230*a* and 230*c* may thereby also be substantially flush with opposed first and second side faces 208*a*, 208*b* of the base 202 when the stem assembly 220 is in the collapsed position.

In some embodiments, the hinge barrels 238*a*', 238*b* of the second hinge 234*b* are received snugly in the first pair of notches 258*a* and the hinge barrels 238*b*', 238*c* of the third hinge 234*c* are received snugly in the second pair of notches 258*b*, when the stem assembly 220 is in the collapsed position. The close engagement of the hinge barrels 238*a*', 238*b* and 238*b*', 238*c* with the notches 238*a*, 238*b* may help to maintain the stem assembly 220 in the collapsed position until the stem assembly 220 is released by the user into the extended position. To release the stem assembly 220, the user may apply upward pressure to the third stem section 230*c*.

In some embodiments, the smoking pipe 200 may comprise at least one magnet to releasably secure the stem assembly 220 to at least one of the cover member 240 and the base 202.

As shown in FIG. 11, the second side face 208*b* of the base 202 may comprise at least one first securing magnet 244*a* and the third stem section 230*c* may comprise at least one second securing magnet 244*b*, received in respective recesses 253*a* and 253*b*. In some embodiments, two first securing magnets 244*a* and two second securing magnets 244*b* are provided. In other embodiments, any other suitable number of first and second securing magnets 244*a*, 244*b* may be provided.

The first securing magnets 244*a* may be of opposite polarity to the second securing magnets 244*b*. When the stem assembly 220 is in the collapsed position, the second securing magnets 244*b* may be brought into proximity to the first securing magnets 244*a* to generate a magnetic force therebetween to hold the third stem section 230*c* to the second side face 208*b* of the base 202. The stem assembly 220 may thereby be secured in the collapsed position.

The first securing magnets 244*a* may be at any position on the second side face 208*b* such that the second securing magnets 244*b* are brought into proximity with the first securing magnets 244*a* when the stem assembly 220 is in the collapsed position. In some embodiments, at least one second securing magnet 244*b* is positioned proximate the second end 226 of the stem assembly 220. In other embodiments, the second securing magnets 244*b* may be at any position on the third stem section 230*c* in which the third stem section 230*c* is in contact with the base 202 when the stem assembly 220 is in the collapsed position.

In other embodiments, respective securing magnets may be positioned on the first side face 208*a* of the base 202 and the first stem section 230*a*. In other embodiments, respective securing magnets may be positioned on the cover member 240 and the second stem section 230*b*. In other embodiments, at least one of the base 202 and the cover member 240 may at least partially comprise a magnetic material and at least one securing magnet may be positioned on the stem assembly 220 to attract the magnetic material, or vice versa.

Although the smoking pipes 100, 200 described herein are shown with stem assemblies 120, 220 comprising two and three stem sections, respectively, embodiments may be provided having additional stem sections. For example, embodiments may be provided having four, five, or six stem sections interconnected by respective articulating connections.

A method of making a portable inhalation apparatus is also provided. The method may be used to make embodiments of the smoking pipe 100, 200 described herein.

Figure 13:
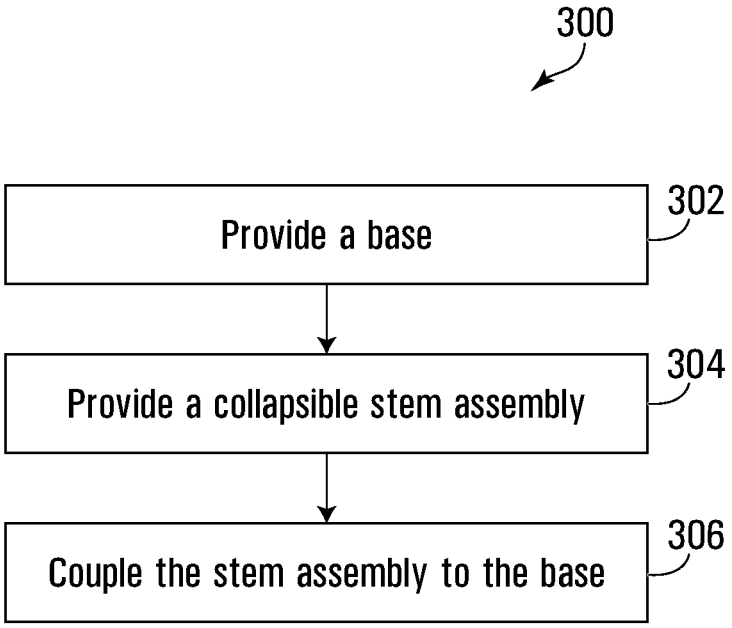
FIG. 13 is a flowchart of an example method for making a portable inhalation apparatus.

FIG. 13 is a flowchart of an example method 300 for making a smoking pipe according to some embodiments. At block 302, a base is provided and, at block 304, a collapsible stem assembly is provided. The base may be similar in structure to the base 102 or the base 202 as described above. The stem assembly may be similar in structure to the stem assembly 120 or the stem assembly 220 as described above. As used herein, "providing" the base and the collapsible stem assembly refers to making, manufacturing, receiving, or otherwise obtaining the base and the collapsible stem assembly. In some embodiments, the base may be provided in the same manner as the stem assembly. In other embodiments, the base may be provided in a different manner than the stem assembly.

At block 306, the stem assembly may then be coupled to the base. In some embodiments, the stem assembly may be coupled to the base using an articulating connection. In some embodiments, the articulating connection comprises a hinge. In other embodiments, the articulating connection may comprise any other suitable connection that allows the stem assembly to rotate with respect to the base. In other embodiments, the stem assembly is coupled to the base using any suitable coupling means.

In some embodiments, providing the collapsible stem assembly further comprises interconnecting at least two stem sections with at least one articulating connection. In some embodiments, the articulating connection is a hinge. In other embodiments, the articulating connection is any other suitable connection that allows at least one of the stem sections to rotate with respect to an adjacent stem section. In some embodiments, the method further comprises forming a longitudinal conduit through the collapsible stem assembly. In some embodiments, forming the longitudinal conduit comprises forming a channel through each of the stem sections. In some embodiments, each stem section may be produced, for example by injection molding or 3D printing, having a channel therethrough. In other embodiments, the channels may be formed by boring a hole through each stem section.

In some embodiments, the method further comprises forming a chamber in the base and forming a ventilation channel from the chamber to an outer face of the base. In some embodiments, the base may be produced, for example by injection molding or 3D printing, having at least one of the chamber and the ventilation channel formed therein. In other embodiments, at least one of the chamber and the ventilation chamber may be formed by boring a hole into the base. In some embodiments, the method further comprises providing a cover member to cover the chamber of the base. In some embodiments, the cover member is pivotably attached to the base with a suitable coupling mechanism, for example, a fastener or a hinge.

Various modifications besides those already described are possible without departing from the concepts disclosed herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly reference.

Although particular embodiments have been shown and described, it will be appreciated by those skilled in the art that various changes and modifications might be made without departing from the scope of the disclosure. The terms and expressions used in the preceding specification have been used herein as terms of description and not of limitation, and there is no intention in the use of such terms and expressions of excluding equivalents of the features shown and described or portions thereof.

The invention claimed is:

1. A portable inhalation apparatus, comprising:

a base comprising a chamber and a ventilation channel extending from the chamber to an outer face of the base;

a collapsible stem assembly defining a longitudinal conduit therethrough, the stem assembly having a first end and an opposed second end, the first end coupled to the base such that the longitudinal conduit is alignable with the ventilation channel and the second end comprising a suction opening to the longitudinal conduit;

wherein the collapsible stem assembly has an extended position in which the stem assembly extends away from the base and a collapsed position in which the stem assembly is collapsed towards the base;

wherein the stem assembly comprises a first stem section and a second stem section, the first stem section being rotatably coupled to the base via a first hinge and the second stem section being rotatably coupled to the first stem section via a second hinge; and wherein the first and second stems sections are rotatable about the first and second hinges, respectively, towards the base to collapse the stem assembly.

2. The portable inhalation apparatus of claim 1, wherein the second end of the stem assembly is distal the base and the suction opening is in fluid communication with the open chamber via the longitudinal conduit, when the collapsible stem assembly is in the extended position.

3. The portable inhalation apparatus of claim 1, wherein the second end is proximate the base, when the stem assembly is in the collapsed position.

4. The portable inhalation apparatus of claim 1, wherein the stem assembly further comprises a third stem section rotatably coupled to the second stem section via a third hinge.

5. The portable inhalation apparatus of claim 1, further comprising at least one magnet positioned on at least one of the base and the stem assembly to generate a magnetic force to hold the stem assembly in the extended position.

6. The portable inhalation apparatus of claim 5, wherein the at least one magnet comprises a first magnet positioned on the base proximate to the stem assembly and a second magnet positioned on the stem assembly such that a magnetic force is generated between the first magnet and the second magnet when the stem assembly is in the extended position.

7. The portable inhalation apparatus of claim 1, further comprising a cover member that engages the base to cover the chamber.

8. The portable inhalation apparatus of claim 7, wherein the cover member is pivotably attached to the base, the cover member pivotable between an open position in which the open chamber is uncovered and a covering position in which the open chamber is covered.

9. The portable inhalation apparatus of claim 7, further comprising at least one securing magnet positioned to magnetically engage the stem assembly with the base or the cover member when the stem assembly is in the collapsed position.

10. The portable inhalation apparatus of claim 9, wherein the at least one securing magnet comprises a first securing magnet positioned on one of the base or the cover member and a second securing magnet positioned on the stem assembly such that a magnetic force is generated between the first securing magnet and the second securing magnet when the stem assembly is in the collapsed position.

11. The portable inhalation apparatus of claim 7, wherein the cover member provides clearance for at least a portion of the stem assembly when the stem assembly is in the collapsed position.

12. The portable inhalation apparatus of claim 11, wherein the cover member provides clearance for at least a portion of the second hinge when the stem assembly is in the collapsed position.

13. The portable inhalation apparatus of claim 12, wherein the cover member comprises a first pair of notches and the second hinge comprises a first pair of hinge barrels, and wherein the first pair of notches provides clearance for the first pair of hinge barrels when the stem assembly is in the collapsed position.

14. The portable inhalation apparatus of claim 13, wherein the stem assembly further comprises a third stem section rotatably coupled to the second stem section by a third hinge and wherein the cover member provides clearance for at least a portion of the third hinge when the stem assembly is in the collapsed position.

15. The portable inhalation apparatus of claim 14, wherein the cover member further comprises a second pair of notches and the third hinge comprises a second pair of hinge barrels, and wherein the second pair of notches provides clearance for the second pair of hinge barrels when the stem assembly is in the collapsed position.

16. A method for making a portable inhalation apparatus, the method comprising: providing a base;

providing a collapsible stem assembly, wherein the stem assembly comprises a first stem section and a second stem section, and wherein the first stem section is rotatably coupled to the base via a first hinge and the second stem section is rotatably coupled to the first stem section via a second hinge; and;

coupling the stem assembly to the base, wherein the first and second stem sections are rotatable about the first and second hinges, respectively, towards the base to collapse the stem assembly.

17. The method of claim 16, further comprising providing a third stem section and rotatably coupling the third stem section to the second stem section.

18. The method of claim 16, further comprising providing a cover member and pivotably attaching the cover member to the base.

19. The method of claim 18, wherein the cover member provides clearance for at least a portion of the stem assembly when the stem assembly is collapsed.

20. The method of claim 19, wherein the cover member provides clearance for at least a portion of the second hinge when the stem assembly is collapsed.

* * * * *